US011312155B2

(12) United States Patent
Raisanen et al.

(10) Patent No.: US 11,312,155 B2
(45) Date of Patent: Apr. 26, 2022

(54) BELT ROLLER PLATENS

(71) Applicant: Hewlett-Packard Development Company, L.P., Spring, TX (US)

(72) Inventors: Matthew Raisanen, Vancouver, WA (US); Richard Lee Brinkly, Vancouver, WA (US); Kevin Lo, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/049,130

(22) PCT Filed: Jun. 21, 2018

(86) PCT No.: PCT/US2018/038765
§ 371 (c)(1),
(2) Date: Oct. 20, 2020

(87) PCT Pub. No.: WO2019/245564
PCT Pub. Date: Dec. 26, 2019

(65) Prior Publication Data

US 2021/0237479 A1 Aug. 5, 2021

(51) Int. Cl.

| | |
|---|---|
| ***B41J 11/00*** | (2006.01) |
| ***B41J 11/06*** | (2006.01) |
| *B41J 11/02* | (2006.01) |
| *B41J 11/13* | (2006.01) |

(52) U.S. Cl.
CPC ..... *B41J 11/0005* (2013.01); *B41J 11/002* (2013.01); *B41J 11/007* (2013.01); *B41J 11/06* (2013.01); *B41J 11/0024* (2021.01); *B41J 11/02* (2013.01); *B41J 11/13* (2013.01)

(58) Field of Classification Search
CPC ..... B41J 11/0005; B41J 11/002; B41J 11/007; B41J 11/06; B41J 11/0024; B41J 11/13; B41J 11/02
See application file for complete search history.

(56) References Cited

U.S. PATENT DOCUMENTS

| | | | | |
|---|---|---|---|---|
| 4,475,896 | A | 10/1984 | Bains | |
| 4,517,042 | A | 5/1985 | Singer | |
| 5,517,292 | A | 5/1996 | Yajima et al. | |
| 5,668,585 | A | 9/1997 | Brechko | |
| 6,026,272 | A * | 2/2000 | Kusaka | G03G 15/2064 219/216 |
| 6,125,256 | A | 9/2000 | Ni et al. | |
| 6,328,440 | B1 | 12/2001 | Medin | |
| 8,073,371 | B2 | 12/2011 | Yamamoto | |
| 9,448,523 | B2 | 9/2016 | Beck et al. | |
| 9,931,870 | B2 | 4/2018 | Kurotobi et al. | |
| 2004/0086307 | A1 | 5/2004 | Murai et al. | |
| 2006/0133867 | A1 | 6/2006 | Coleman et al. | |
| 2009/0207225 | A1 | 8/2009 | Matsuhashi | |
| 2011/0134200 | A1 | 6/2011 | Ikegami | |

* cited by examiner

*Primary Examiner* — Henok D Legesse
(74) *Attorney, Agent, or Firm* — Brooks Cameron & Huebsch PLLC

(57) ABSTRACT

In one example, a heated pressure roller can include a structural element positioned within a belt roller, a platen coupled to the structural element, wherein the platen comprises: a first side to guide a belt of the belt roller to form a first angle on the first side, and a second side to guide the belt of the belt roller to form a second angle on the second side that is different than the first angle.

18 Claims, 3 Drawing Sheets

BELT ROLLER PLATENS

BACKGROUND

Imaging systems, such as printing devices, copiers, etc., may be used to form markings, such as text and images on a physical medium. Imaging systems may form markings on the physical medium by transferring a print substance (e.g., ink, toner, etc.) to the physical medium.

DETAILED DESCRIPTION

Figure 1:
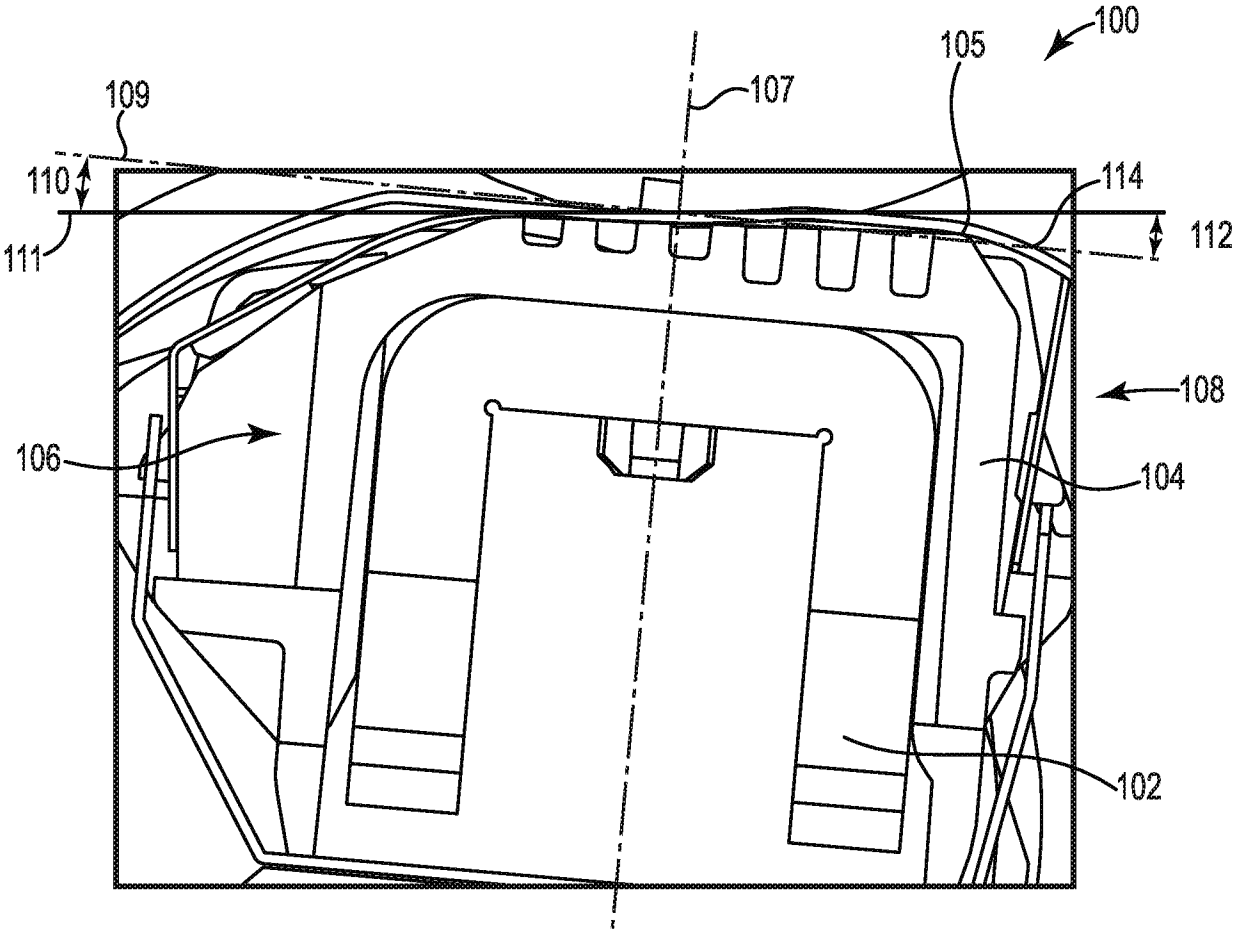
FIG. 1 illustrates an example device for a belt roller.

In some examples, an imaging system can include an inkjet printing device. In some examples, the inkjet printing device can deposit quantities of a print substance on a physical medium. In some examples, the print substance can create a curl, and/or cockle in the physical medium when the print substance deposited on the physical medium is not completely dry. In some examples, a number of physical properties of the physical medium can be changed when the print substance is deposited by the imaging system. For example, the stiffness of the physical medium can be changed when the print substance includes fluid droplets. In some examples, the physical medium with deposited print substance that is not completely dry can be referred to as partially dried media.

The curl, cockle, and/or other physical properties that change due to the print substance can make finishing processes difficult. As used herein, a finishing process can include a process performed the imaging system or finisher device after the print substance is deposited on the physical medium. The partially dried media can provide difficulties when stacking, aligning, and/or finishing. For example, the partially dried media can have distorted properties such as a curl, a cockle, a reduction in stiffness, increased surface roughness, extruding fibers from the surface, misaligned fibers, and/or increased sheet to sheet friction of the media. In some examples, these distorted properties can be caused by printing fluid deposited on the physical medium and the physical medium absorbing the printing fluid. For example, the print substance can be in a liquid state that can be absorbed by a physical medium such as paper. In this example, the liquid state of the print substance can cause the distorted properties of the partially dried media in a similar way that other liquids may distort the properties of the physical medium.

In some examples, a heated pressure roller can be utilized to remove the distorted properties from the physical medium or partially dried medium. For example, the heated pressure roller can be utilized to apply pressure to a surface of the partially dried media and apply heat to the surface of the partially dried media. In this example, the applied heat and pressure can remove or substantially remove the distorted properties of the partially dried media. In some examples, the heated pressure roller can cause the physical medium to curl when the physical medium passes through the heated pressure roller. In some examples, an extent of the curl caused by the heated pressure roller can be based on a quantity of print substance deposited on the physical medium.

In some examples, the curl caused by the heated pressure roller can cause a handling error for the physical medium. For example, the curl caused by the heated pressure roller can direct a leading edge of the physical medium away from a media pathway such that the physical medium may become stuck (e.g., jammed) between the heated pressure roller and the media pathway. In some examples, the systems and devices described herein can utilize a platen to compensate for the curl caused by the heated pressure roller and direct the leading edge of the physical medium into the media pathway even when the quantity of print substance deposited on the physical medium is relatively high. As used herein, a leading edge of the physical medium is an edge of the physical medium that first meets components in a media pathway (e.g., first meets a media path, etc.) in the direction of motion. For example, the leading edge of the physical medium can be the edge that is received by the heated pressure roller first.

A number of systems and devices for a belt roller platen are described herein. In some examples, a heated pressure roller can include a structural element positioned within a belt roller, a platen coupled to the structural element, wherein the platen comprises: a first side to guide a belt of the belt roller to form a first angle on the first side, and a second side to guide the belt of the belt roller to form a second angle on the second side that is different than the first angle. In this example, the second side of the platen can have a different angle to compensate for curl that may be caused by the heated pressure roller. For example, the second side of the platen can have an increased angle to compensate for a curl caused by applying heat and pressure to the physical medium passing through the heated pressure roller.

The figures herein follow a numbering convention in which the first digit corresponds to the drawing figure number and the remaining digits identify an element or component in the drawing. Elements shown in the various figures herein may be capable of being added, exchanged, and/or eliminated so as to provide a number of additional examples of the present disclosure. In addition, the proportion and the relative scale of the elements provided in the figures are intended to illustrate the examples of the present disclosure, and should not be taken in a limiting sense.

FIG. 1 illustrates an example device 100 for a belt roller. In some examples, the device 100 can be a portion of a belt roller. As used herein, a belt roller can be a roller device to transport physical media utilizing a belt 114 that rotates around a belt path. For example, a belt roller can include belt 114 that can be rotated around a belt path in a clockwise or counterclockwise direction with a motor. A belt roller can be different than a cylindrical roller. As used herein, a cylindrical roller can be a roller device that is substantially cylindrical in shape that can rotate around a central axis to move, flatten, or spread a physical media. In some examples, the cylindrical roller can be rotated around the central axis with a motor or other type of device to move the physical media from a first position to a second position.

In some examples, the device 100 can include a structural element 102. As used herein, the structural element 102 can be a physical device positioned within the belt roller. In some examples, the structural element 102 can be a physical structure that can be utilized to mount or hang other devices or elements. For example, the structural element 102 can be a physical structure that can be utilized to mount a platen 104, a heating element, and/or other types of devices that can be utilized within the belt roller.

In some examples, the device 100 can include a platen 104 coupled to the structural element 102. The platen 104 and the structural element 102 are illustrated as separate devices in FIG. 1, but the disclosure is not limited to this example. For example, the structural element 102 and the platen 104 can be the same device or formed together as a single element. As used herein, the platen 104 has a surface to guide a belt 114 of a belt roller and receive pressure from a cylindrical roller. For example, the platen 104 can be surface that interacts with an interior surface of the belt 114 as the belt 114 rotates around a belt path.

In some examples, the platen 104 can have a surface that defines a portion of the belt path. For example, the platen 104 can define the belt path for the belt 114 as illustrated in FIG. 1. In some examples, the platen 104 can include a first side 106 and a second side 108 that are divided by a first dividing line 107. In some examples, the first dividing line 107 can be an imaginary line that divides the platen 104 at or near a center portion of the platen 104.

In some examples, the first side 106 extends from a center of the platen 104 or at the first dividing line 107 in a first direction (e.g., toward the left as illustrated in FIG. 1) and the second side 108 extends from the center of the platen 104 or at the first dividing line 107 in a second direction (e.g., toward the right as illustrated in FIG. 1) that is opposite the first direction. In some examples, the first side 106 extends a first distance from the center of the platen or the first dividing line 107 and the second side 108 extends a second distance from the center of the platen 104 or first dividing line 107. In some examples, the second distance can be greater than the first distance to create a belt path for the belt 114 that is asymmetrical. For example, the belt roller that utilizes the platen 104 can have an asymmetric profile provided by the platen 104. In this example, the asymmetric profile can be a visual profile of the belt path, which can be asymmetric at the first dividing line 107. That is, the profile of the belt path on the first side 106 of the first dividing line 107 may not be a mirror image of the second side 108 of the first dividing line 107.

In some example, the first side 106 of the platen 104 can be an input side of the platen 104 and the second side 108 of the platen 104 can be an output side of the platen 104. In these examples, the first side 106 of the platen 104 can be a first side of a nip and the second side 108 of the platen 104 can be a second side of a nip. As used herein, a nip can be a location where a cylindrical roller makes contact with a surface of the platen 104. In some examples, the first dividing line 107 can be located within the nip on the surface of the platen 104. In some examples a second dividing line 109 can be perpendicular to the first dividing line 107. For example, the second dividing line 109 can be positioned at a 90 degree angle to the first dividing line 107. In some examples, the third dividing line 111 can be positioned along a top surface of the platen 104. In some examples, a first angle 110 and a second angle 112 can be illustrated as angles between the second dividing line 109 and the third dividing line 111. That is, the first angle 110 and the second angle 112 can be angles between the second dividing line 109 and the surface of the platen 104.

In some examples, the first side 106 of the platen 104 can interact with an interior surface of the belt 114 to generate a first angle 110. In some examples, the first side 106 of the platen 104 can be an input side of a nip of the platen 104. As used herein, the input side of a nip of the platen 104 can be a side that receives the physical medium from a print zone of a printing device. In some examples, the input side of the nip of the platen 104 can generate the first angle 110 to receive the physical medium from a roller or combination of rollers moving the physical medium from the print zone to the belt roller that includes the platen 104.

In some examples, the second side 108 of the platen 104 can interact with an interior surface of the belt 114 to generate a second angle 112. In some examples, the second side 108 of the platen 104 can be an output side of a nip of the platen 104. As used herein, the output side of the nip of the platen 104 can be a side that provides the physical medium to a media pathway. In some examples, the media pathway can include a roller or combination of rollers for moving the physical medium to an output bin and/or a finisher device that can perform a finishing process as described herein.

In some examples, the first angle 110 can be a different angle than the second angle 112. For example, the first angle 110 can be a relatively smaller angle than the second angle 112. In some examples, the first angle 110 and the second angle 112 can be angles of the belt roller. For example, the first angle 110 can be an angle between a surface of the belt 114 or surface of the platen 104 and the third dividing line 111. In this example, the second angle 112 can be an angle between a surface of the belt 114 or a surface of the platen 104 and the third dividing line 111. In some examples, the first angle 110 can provide a first belt angle on the first side 106 of the platen 104 and the second angle 112 can provide a second belt angle on the second side 108 of the platen 104.

As used herein, a belt angle is an angle between a top surface of the belt 114 and a media path. For example, the belt angle on the first side 106 of the platen 104 can be an angle between an exterior surface of the belt 114 and a media path that provides the physical medium from the print zone. In another example, the belt angle on the second side 108 of the platen 104 can be an angle between an exterior surface of the belt 114 and a media path that can receive the physical media from the belt 114 and provide the physical media to a finisher device.

In some examples, the difference between the first angle 110 and the second angle 112 can provide an asymmetrical belt path for the belt 114 interacting with the platen 104. In some examples, the asymmetrical belt path for the belt 114 can provide a greater angle on the second side 108 of the platen 104. In some examples, the second angle 112 on the second side 108 of the platen 104 can be a peel angle for the physical medium. As used herein, a peel angle can include an angle that is utilized to release the physical medium from the belt 114 of the belt roller.

In some examples, the platen 104 can include a lip portion 105 to increase the peel angle. In some examples, the lip portion 105 of the platen 104 can be a top surface of the platen 104 between the first dividing line 107 and an edge of the second side 108 of the platen 104. In some examples, the lip portion 105 can be an angled portion of the platen 104 to provide a relatively greater peel angle and/or a relatively larger second angle 112. In some examples, the lip portion 105 can extend beyond a symmetrical perimeter of the belt path of a belt roller. As used herein, a symmetrical perimeter is a perimeter around the platen 104 that is symmetrical or substantially symmetrical.

In some examples, the lip portion 105 can be utilized to increase a size of the peel angle to compensate for a curl in the physical medium caused by providing heat and/or pressure on a surface of the physical medium. As described herein, a heated pressure roller can utilize heat and/or pressure to remove and/or reduce distorted properties from the physical medium or partially dried medium. As noted above, at times, however, the application of heat and/or pressure using the heated pressure roller can cause paper jams or other types of malfunctions when the second angle 112 is the same as the first angle 110.

Figure 2:
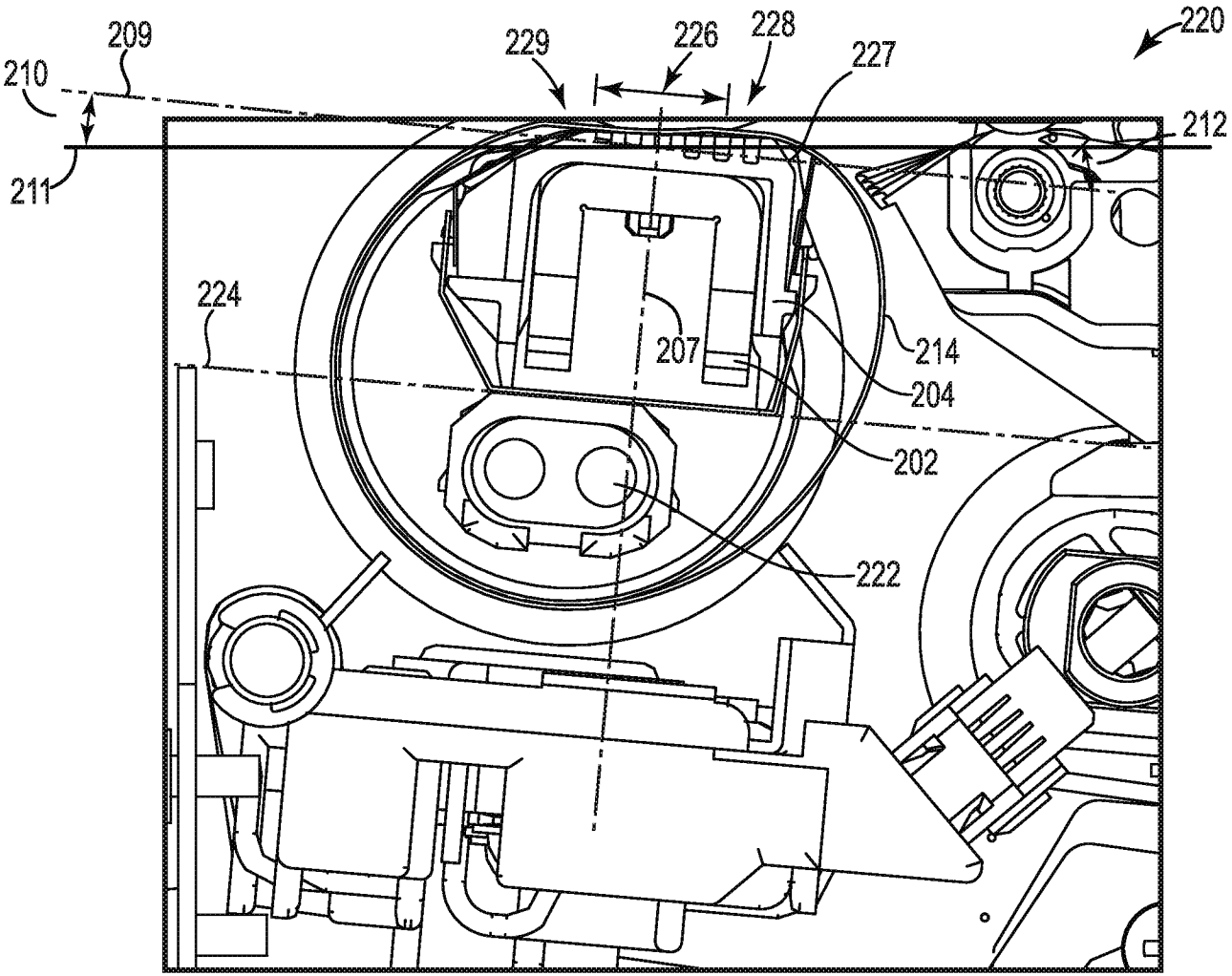
FIG. 2 illustrates an example belt roller.

FIG. 2 illustrates an example belt roller 220. The belt roller 220 can be part of a heated pressure roller. As described herein, a heated pressure roller can be a device that can include a belt roller such as belt roller 220 and a cylindrical roller. In some examples, the belt roller 220 can include a heat source 222 to apply heat and the cylindrical roller can apply pressure at a nip 226 of a platen 204 within the belt roller 220. As described herein, the nip 226 can be a location of the platen 204 where a cylindrical roller makes contact with the platen 204.

In some examples, the belt roller 220 can include a structural element 202. As used herein, the structural element 202 can be a physical device positioned within the belt roller 220. In some examples, the structural element 202 can be a physical structure that can be utilized to mount or hang other devices or elements. For example, the structural element 202 can be a physical structure that can be utilized to mount a platen 204, a heat source 222, and/or other types of devices that can be utilized within the belt roller 220. In some examples, the platen 204 can guide a belt 214 of the belt roller 220 asymmetrically between an input and an output of a nip 226 between the belt roller 220 and a cylindrical roller of the heated pressure roller such that a first angle 210 is generated by the platen 204 at the input and a second angle 212 is generated by the platen 204 at the output. As described herein, the first angle 210 and the second angle 212 can be illustrated as angles between a dividing line 209 and a dividing line 211. As described herein, the dividing line 209 can be perpendicular to a center point of the platen 204 and the dividing line 111 can be positioned along a top surface of the platen 204.

In some examples, the belt roller 220 can include a platen 204 coupled to the structural element 202. The platen 204 and the structural element 202 are illustrated as separate devices in FIG. 2, but the disclosure is not limited to this example. For example, the structural element 202 and the platen 204 can be the same device or formed together as a single element. As used herein, the platen 204 can include a surface to guide a belt 214 of the belt roller 220 and receive pressure from a cylindrical roller. For example, the platen 204 can have a surface that interacts with an interior surface of the belt 214 as the belt 214 rotates around a belt path. In some examples, the belt path can move around the platen 204 and below the heat source 222 as illustrated in FIG. 2.

In some examples, the platen 204 can have a surface that defines a portion of the belt path. For example, the platen 204 can define the belt path for the belt 214 as illustrated in FIG. 2. In some examples, the platen 204 can include a first side 229 and a second side 228 that are divided by the dividing line 207 of the platen 204. In some example, the first side 229 of the platen 204 can be an input side of the platen 204 and the second side 228 of the platen 204 can be an output side of the platen 204. In these examples, the first side 229 of the platen 204 can be a first side of the nip 226 and the second side 228 of the platen 204 can be a second side of the nip 226. As used herein, the nip 226 can be a location where a cylindrical roller makes contact with a surface of the platen 204.

In some examples, the first side 229 of the platen 204 can interact with an interior surface of the belt 214 to generate a first angle 210. In some examples, the first side 229 of the platen 204 can be an input side of the nip 226 of the platen 204. As used herein, the input side of the nip 226 of the platen 204 can be a side that receives the physical medium from a print zone of a printing device. In some examples, the input side of the nip 226 of the platen 204 can generate the first angle 210 to receive the physical medium from a roller or combination of rollers moving the physical medium from the print zone to the belt roller 220 that includes the platen 204. In some examples, the belt roller 220 can receive partially dried media at a first angle 210 at the input and further to eject the partially dried media at a second angle 212 at the output.

In some examples, a first edge or first side 229 of the platen 204 positioned at the input is a first distance with respect to the dividing line 207 and a second edge or second side 228 of the platen 204 positioned at the output is a second distance with respect to the dividing line 207, the second distance being greater than the first distance. In some examples, the first distance can be a distance between a first edge on the first side 229 (e.g., left edge as illustrated in FIG. 2) of the platen 204 and the dividing line 207. In some examples, the second distance can be a distance between a second edge on the second side 228 (e.g., right edge as illustrated in FIG. 2) of the platen 204 and the dividing line 207.

In some examples, the second side 228 of the platen 204 can interact with an interior surface of the belt 214 to generate a second angle 212. In some examples, the second side 228 of the platen 204 can be an output side of the nip 226 of the platen 204. As used herein, the output side of the nip 226 of the platen 204 can be a side that provides the physical medium to a media pathway. In some examples, the media pathway can include a roller or combination of rollers for moving the physical medium to an output bin and/or a finisher device that can perform a finishing process as described herein.

In some examples, the first angle 210 can be a different angle than the second angle 212. For example, the first angle 210 can be a smaller angle than the second angle 212. In some examples, the first angle 210 and the second angle 212 can be angles of the belt roller 220. For example, the first angle 210 can be an angle between a surface of the belt 214 and a parallel line that crosses the surface of the platen 204 and the second angle 212 can be an angle between a surface of the belt 214 and the parallel line that crosses the surface of the platen 204. In some examples, the first angle 210 can provide a belt angle on the first side 229 of the platen 204 and the second angle 212 can provide a belt angle on the second side 228 of the platen 204.

In some examples, the belt roller 220 can have a belt path for the belt 214 that is asymmetrical due to the first angle 210 being different than the second angle 212. As used herein a symmetrical belt path includes a belt path that includes a first side and a second side that substantially mirror images. As used herein, an asymmetrical belt path includes a belt path that includes a first side 229 with a first angle 210 and a second side 228 with a second angle 212 that is different than the first angle 210. In some examples, a symmetrical belt path can include a substantially cylindrical belt path. For example, the second side 228 could be altered to a position represented by path 227. In this example, the path 227 can represent when the belt path is symmetrical. That is, the path 227 can represent a position when the first angle 210 is the same or substantially the same as the second angle 212. In some examples, the second side 228 of the platen 204 can extend beyond a symmetrical perimeter of the belt path of a belt roller 220. As used herein, a symmetrical perimeter is a perimeter around the platen 204 that is symmetrical or substantially symmetrical. In some examples, the path 227 can represent the symmetrical perimeter of the second side 228 and thus, the second side 228 of the platen 204 can extend outside the path 227.

In some examples, the second side 228 of the platen 204 can be angled away from the structural element 202 to generate an asymmetrical belt path. For example, the first side 229 can be a first height that can increase through the nip 226 to a second height on the second side 228. In this example, the second height on the second side 228 can be greater than the first height on the first side 229. In some examples, the difference between the first height and the second height can generate the second angle 212 and belt angle as described herein.

In some examples, the belt roller 220 can include a dividing line 224. The dividing line can separate the heat source 222 and the platen 204 coupled to the structural element 202. In some examples, the dividing line 224 can be an imaginary line that can separate the belt roller 220 into a first portion that includes the heat source 222 and a second portion that includes the platen 204 coupled to the structural element 202. In some examples, the first portion of the belt roller 220 can be symmetrical or substantially symmetrical and the second portion of the belt roller 220 can be asymmetrical or substantially asymmetrical.

As described herein, the second side 228 of the belt roller 220 can be utilized to increase a size of the peel angle or belt angle corresponding to the second angle 212 to compensate for a curl in the physical medium caused by providing heat and/or pressure on a surface of the physical medium. As described herein, a heated pressure roller can utilize heat and/or pressure to remove and/or reduce distorted properties from the physical medium or partially dried medium. As noted above, at times, however, the application of heat and/or pressure using the heated pressure roller can cause paper jams or other types of malfunctions when the second angle 212 is the same as the first angle 210 and the belt angles are the same.

Figure 3:
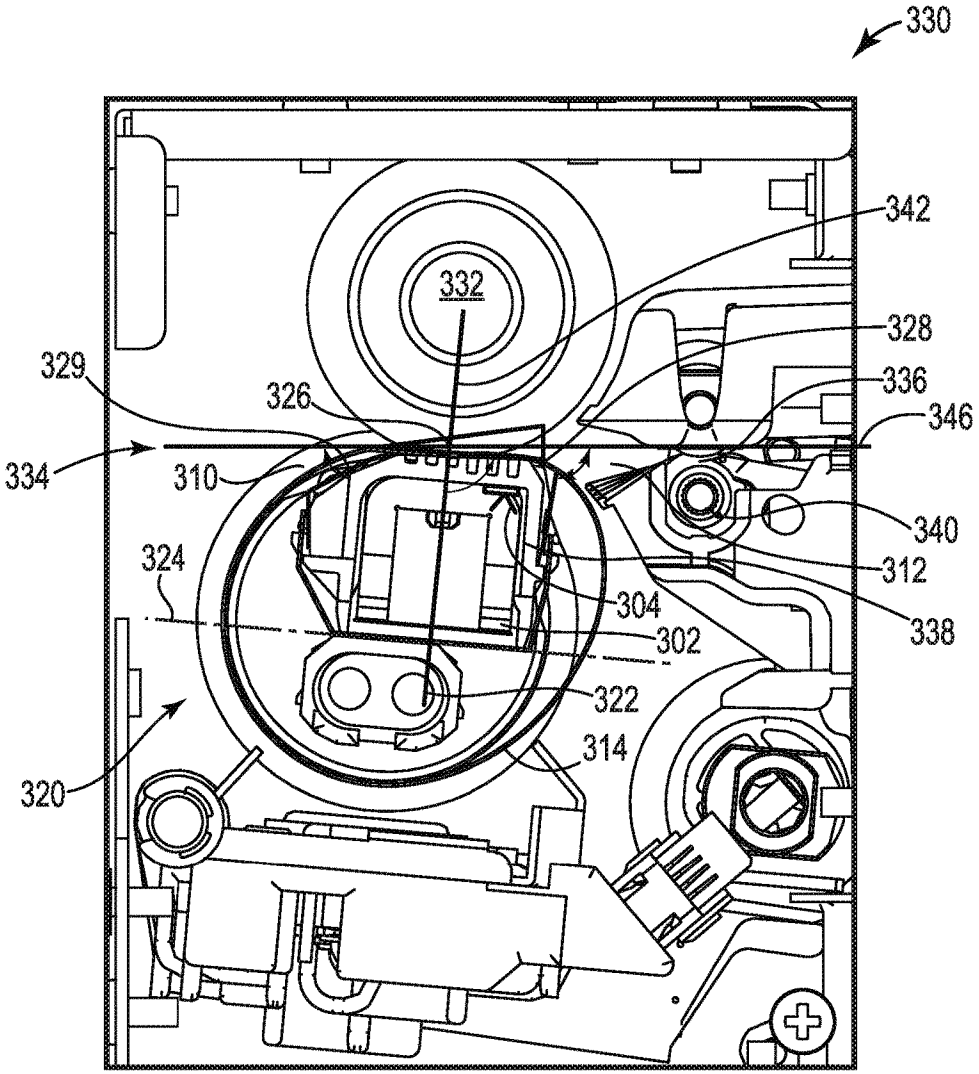
FIG. 3 illustrates an example system for a platen of a heated pressure roller.

FIG. 3 illustrates an example system 330 for a platen 304 of a heated pressure roller. In some examples, the system 330 can be utilized as component of a conditioner for partially dried physical media. As used herein, a conditioner can be a device to remove moisture and/or remove distorted properties from the physical medium of an imaging device. In some examples, the system 330 can apply pressure on a first side of the partially dried media utilizing a cylindrical roller 332 and apply heat on a second side of the partially dried media utilizing a belt roller 320. In some examples, the system 330 can increase drying and/or evaporation of a print substance (e.g., printing fluid, ink, toner, etc.) applied to the partially dried media.

In some examples, the system 330 can receive partially dried media at an input 334 of the system 330. In some examples, the input 334 can be a media path coupled to a print zone for depositing the print substance on to the physical medium. In some examples, the system 330 can include a cylindrical roller 332 that can act as a pressure roller to apply pressure on a first side of the physical medium. As used herein, a pressure roller is a solid roller that can apply pressure to a nip 326 of a platen 304 coupled to a structured element 302. In some examples, the cylindrical roller 332 can include a contact zone or nip 326 as described herein.

In some examples, the belt roller 320 can apply heat to a second side of the physical medium. In some examples, the belt roller can include a heat source 322. In some examples, the heat source 322 can include a halogen heat source, a ceramic heat source, an inductive heat source, a convective heat source, a heated air heat source, among other devices that can generate heat. In some examples, the heat source 322 can generate heat that is transferred to a heat transfer belt such as belt 314. In some examples, the belt 314 can rotate around the belt roller and contact the second side of the physical medium within the nip 326 of the platen 304.

In some examples, the belt roller 320 can include a structural element 302. In some examples, the structural element 302 can be positioned between the heat source 322 and the platen 304. In some examples, the structural element 302 can be a physical structure that can be utilized to mount a platen 304, a heat source 322, and/or other types of devices that can be utilized within the belt roller 320. In some examples, the belt roller 320 can include a platen 304 coupled to the structural element 302. As used herein, the platen 304 can include a surface to guide a belt 314 of the belt roller 320 and receive pressure from a cylindrical roller 332. For example, the platen 304 can be surface that interacts with an interior surface of the belt 314 as the belt 314 rotates around a belt path. In some examples, the belt path can move around the platen 304 and below the heat source 322 as illustrated in FIG. 3.

In some examples, the platen 304 can include a surface that defines a portion of the belt path. For example, the platen 304 can define the belt path for the belt 314 as illustrated in FIG. 3. In some examples, the platen 304 can include a first side 329 and a second side 328 that are divided by dividing line 342 or contact area of the cylindrical roller 332 of the platen 304. In some example, the first side 329 of the nip 326 can be an input side of the platen 304 and the second side 328 of the nip 326 can be an output side of the platen 304. In these examples, the first side 329 of the platen 304 can be a first side of the nip 326 and the second side 328 of the platen 304 can be a second side of the nip 326. As used herein, the nip 326 can be a location where the cylindrical roller 332 makes contact with a surface of the platen 304.

In some examples, the first side 329 of the platen 304 can interact with an interior surface of the belt 314 to generate a first angle 310. In some examples, the first side 329 of the platen 304 can be an input side of the nip 326 of the platen 304. As used herein, the input side of the nip 326 of the platen 304 can be a side that receives the physical medium from a print zone of a printing device via a media path 334. In some examples, the input side of the nip 326 of the platen 304 can generate the first angle 310 to receive the physical medium from a roller or combination of rollers moving the physical medium through the media path 334 from the print zone to the belt roller 320 that includes the platen 304.

In some examples, the second side 328 of the platen 304 can interact with an interior surface of the belt 314 to generate a second angle 312. In some examples, the second side 328 of the platen 304 can be an output side of the nip 326 of the platen 304. As used herein, the output side of the nip 326 of the platen 304 can be a side that provides the physical medium to a media pathway 336. In some examples, the media pathway 336 can include a roller 340 or combination of rollers for moving the physical medium to an output bin and/or a finisher device that can perform a finishing process as described herein.

In some examples, the first angle 310 can be a different angle than the second angle 312. For example, the first angle 310 can be a relatively smaller angle than the second angle 312. In some examples, the first angle 310 and the second angle 312 can be angles of the belt roller 320. For example, the first angle 310 can be an angle between a surface of the belt 314 and a dividing line that is parallel to the surface of the platen 304 and the second angle 312 can be an angle between a surface of the belt 314 and the dividing line that is parallel to the surface of the platen 304. In some examples, the first angle 310 can provide a belt angle on the first side 329 of the platen 304 and the second angle 312 can provide a belt angle on the second side 328 of the platen 304.

In some examples, the belt roller 320 can have a belt path for the belt 314 that is asymmetrical due to the first angle 310 being different than the second angle 312. As used herein a symmetrical belt path includes a belt path that includes a first side and a second side that substantially mirror images. As used herein, an asymmetrical belt path includes a belt path that includes a first side 329 with a first angle 310 and a second side 328 with a second angle 312 that is different than the first angle 310.

In some examples, the belt roller 320 can include a dividing line 324. The dividing line 324 can separate the heat source 322 and the platen 304 coupled to the structural element 302. In some examples, the dividing line 324 can be an imaginary line that can separate the belt roller 320 into a first portion that includes the heat source 322 and a second portion that includes the platen 304 coupled to the structural element 302. In some examples, the first portion of the belt roller 320 can be symmetrical or substantially symmetrical and the second portion of the belt roller 320 can be asymmetrical or substantially asymmetrical.

In some examples, the second side 328 of the platen 304 can be angled away from the structural element 302 to generate an asymmetrical belt path. For example, the first side 329 can be a first height that can increase through the nip 326 to a second height on the second side 328. In this example, the second height on the second side 328 can be greater than the first height on the first side 329. In some examples, the difference between the first height and the second height can generate the second angle 312, a third angle 338, and/or a belt angle as described herein. In some examples, the system 330 can include a dividing line 342. The dividing line 342 can pass through a center point of the structural element 302. In some examples, the dividing line 342 can pass through the structural element 302 such that a surface of the structural element 302 is perpendicular to the dividing line 342.

In some examples, the system 330 can include a dividing line 346 that can be parallel to the surface of the platen 304. For example, the dividing line 346 can be aligned and parallel with the first side 329, the nip 326, and/or the second side 328 of the platen 304. In some examples, the dividing line 346 can cross the dividing line 342. In some examples, the angle 338 created between the dividing line 342 and the dividing line 346 can illustrate an increased belt angle at the second side 328 or output side of the nip 326 compared to the first side 329 or input side of the nip 326.

As described herein, the second side 328 of the belt roller 320 can be utilized to increase a size of the peel angle or angle 338 corresponding to the second angle 312 to compensate for a curl in the physical medium caused by providing heat and/or pressure on a surface of the physical medium. As described herein, a heated pressure roller can utilize heat and/or pressure to remove and/or reduce distorted properties from the physical medium or partially dried medium. As noted above, at times, however, the application of heat and/or pressure using the heated pressure roller can cause paper jams or other types of malfunctions when the second angle 312 is the same as the first angle 310 and the belt angles are the same.

The above specification, examples and data provide a description of the method and applications and use of the system and method of the present disclosure. Since many examples can be made without departing from the spirit and scope of the system and method of the present disclosure, this specification merely sets forth some of the many possible example configurations and implementations.

What is claimed:

1. A heated pressure roller, comprising:
- a structural element positioned within a belt roller;
- a platen coupled to the structural element, the platen including a first surface and a second surface; and
- a belt pathway, wherein a portion of the belt pathway is located between the platen and a cylindrical roller, the cylindrical roller contacting a belt of the belt pathway at a nip, wherein the nip includes:
  - a first side located on a portion of the first surface of the platen; and
  - a second side located on a portion of the second surface of the platen, wherein the second side of the nip is angled with respect to the first side of the nip.

2. The heated pressure roller of claim 1, wherein the first side of the nip extends from a center of the nip in a first direction and the second side of the nip extends from the center of the nip in a second direction that is opposite the first direction.

3. The heated pressure roller of claim 1, wherein the first surface of the platen extends a first distance from the center of the nip and the second surface of the platen extends a second distance from the center of the nip.

4. The heated pressure roller of claim 3, wherein the second distance is greater than the first distance.

5. The heated pressure roller of claim 1, wherein the belt roller has an asymmetric profile provided by the platen.

6. The heated pressure roller of claim 1, wherein the second side of the nip is angled with respect to the first side of the nip at an angle that is greater than 180 degrees.

7. The heated pressure roller of claim 1, wherein the first surface of the platen corresponds to the first side of the nip and the second surface of the platen corresponds to the second side of the nip such that the second surface of the platen is correspondingly angled with respect to the first surface of the platen at the angle that is greater than 180 degrees.

8. A system for a heated pressure roller, comprising:
- a heat source positioned within a belt roller of the heated pressure roller;
- a structural element positioned within the belt roller of the heated pressure roller; and
- a platen to guide a belt of the belt roller asymmetrically between an input of a nip and an output of the nip, the nip located between the belt roller and a cylindrical roller of the heated pressure roller, wherein:
  - the platen includes a first surface and a second surface; and
  - the nip includes:
    - a first side located on a portion of the first surface of the platen; and
    - a second side located on a portion of the second surface of the platen, wherein the second side of the nip is angled with respect to the first side of the nip.

9. The system of claim 8, wherein a first edge of the platen positioned at the input of the nip is a first distance and a second edge of the platen positioned at the output of the nip is a second distance that is greater than the first distance.

10. The system of claim 8, wherein the belt roller is to receive partially dried media at a first angle at the input of the nip and further to eject the partially dried media at a second angle at the output of the nip.

11. The system of claim 10, wherein the first surface of the platen is located at the input of the nip and the second surface of the platen is located at the output of the nip.

12. The system of claim 11, wherein the first surface of the platen is smaller than the second surface of the platen.

13. The system of claim 8, wherein the structural element is positioned between the heat source and the platen.

14. The system of claim 13, wherein:

a first portion of a belt path of the belt roller includes the platen; and a second portion of the belt path of the belt roller includes the heat source, wherein the second portion of the belt path of the belt roller is symmetrical.

15. A printing device, comprising:

a heated pressure roller to receive partially dried media at an input of a nip of the heated pressure roller and provide the partially dried media to a media pathway at an output of the nip of the heated pressure roller, the heated pressure roller comprising:

a belt roller that includes a belt that rotates around a heat source, a structural element, and a platen coupled to the structural element to guide the belt, wherein the platen includes:

a first surface;

a second surface; and a lip portion that extends toward the media pathway; and a cylindrical roller to apply pressure on the platen at the nip, wherein the nip is a location where the cylindrical roller makes contact with a surface of the platen and includes:

a first side located on a portion of the first surface of the platen; and a second side located on a portion of the second surface of the platen, wherein the second side of the nip is angled with respect to the first side of the nip.

16. The printing device of claim 15, wherein the lip portion extends beyond symmetrical perimeter of the belt roller.

17. The printing device of claim 15, wherein the lip portion provides an asymmetrical belt path for the belt of the belt roller.

18. The printing device of claim 15, wherein the lip portion is to increase a peel angle for the partially dried media at the output of the heated pressure roller.

* * * * *